United States Patent [19]

Kadoory

[11] 4,422,545

[45] Dec. 27, 1983

[54] COSMETIC DISPLAYER AND DISPENSER

[75] Inventor: Shlomo J. Kadoory, New York, N.Y.

[73] Assignee: Revlon, Inc., New York, N.Y.

[21] Appl. No.: 379,248

[22] Filed: May 17, 1982

[51] Int. Cl.[3] ..... A45D 40/06; B65D 51/28; B65D 65/16

[52] U.S. Cl. ..... 206/45.34; 206/581; 206/38; 220/212; 401/34; 401/98

[58] Field of Search ..... 206/45.34, 581, 37, 206/38; 220/252, 212; 215/228; 401/98, 34

[56] References Cited

U.S. PATENT DOCUMENTS

| | | | |
|---|---|---|---|
| 3,152,691 | 10/1964 | Hultgren | 220/352 |
| 3,162,304 | 12/1964 | Bau | 220/352 |
| 3,367,484 | 2/1968 | Nelson | 206/540 |

FOREIGN PATENT DOCUMENTS

| | | | |
|---|---|---|---|
| 2238447 | 3/1975 | France | 401/98 |
| 319505 | 2/1957 | Switzerland | 401/98 |

*Primary Examiner*—William T. Dixson, Jr.

[57] ABSTRACT

There is disclosed herein a cosmetic displayer and dispenser, especially for use with lipsticks, having a holder assembly, said assembly being movable up and down, a top or cover and a transparent base able to be filled with cosmetic.

2 Claims, 3 Drawing Figures

Fig. 1.
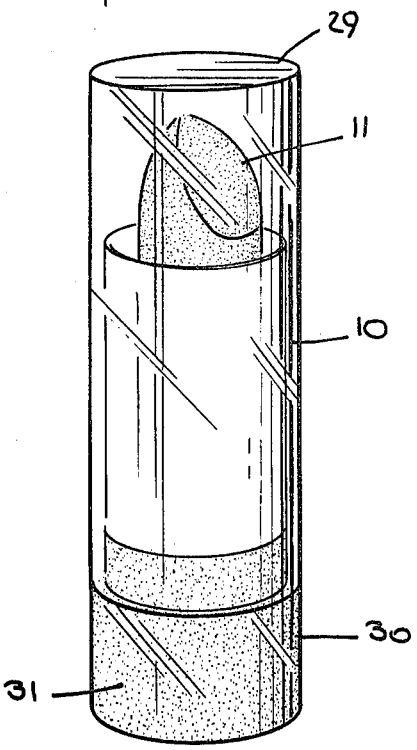
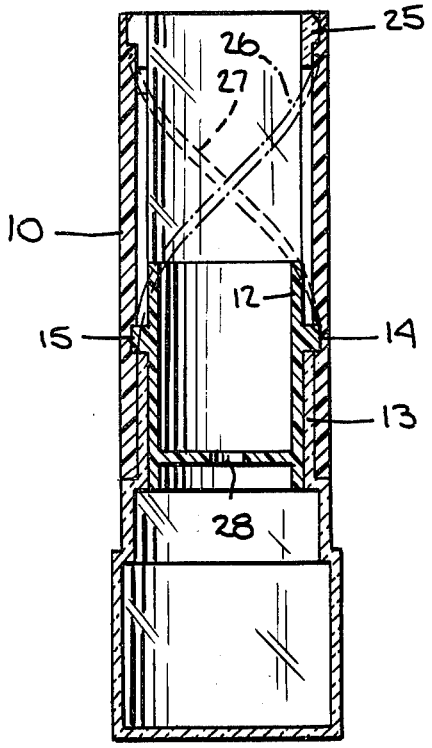
Fig. 2.
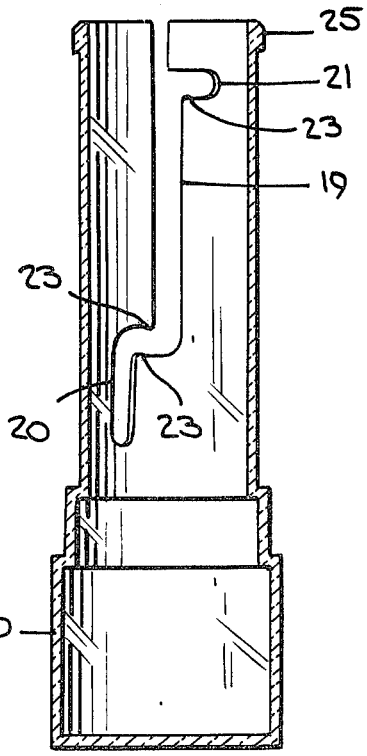
Fig. 3.

COSMETIC DISPLAYER AND DISPENSER

BACKGROUND OF THE INVENTION

This invention relates to holders for displaying and dispensing projectable cosmetic sticks. More particularly, this invention relates to a lipstick holder which enables the potential purchaser to more easily view the color of the lipstick.

Holders for cosmetic sticks such as lipsticks or similar soft solid materials formed by molding or extrusion frequently have transparent covers, and are constructed so that the tip of the lipstick will be visible through the transparent cover, even when the lipstick is fully retracted into the holder. This is accomplished by locating the elevator cup holding the lipstick at a predetermined height in the holder. While such design permits display of the lipstick being used and enables the user to see the actual color without having to remove the cover, it is sometimes the situation that the true color is not as clearly seen as would be desired. An example of this type of cosmetics holder is described in U.S. Pat. No. 4,108,558.

Another method of displaying cosmetics such as lipsticks is to utilize a dispenser having a "bullet" or dummy made of plastic placed at one end of the dispenser and containing lipstick. This display dispenser is used on the display counter as a tester since the consumer can scan the colors of the exposed "bullets" and select a lipstick color. The problem of displaying cosmetics in this fashion is that it is often difficult and expensive to color the plastic bullet the exact color of the cosmetic.

It is the general object of this invention to provide a cosmetic container in which the cosmetic material may be readily viewed from the top and bottom.

Other objects, features and advantages of this invention will be apparent from the following detailed description of the invention when taken in conjunction with the accompanying drawings of an embodiment of the invention, in which:

FIG. 1 is a perspective view of a holder in the closed position containing cosmetic material.

FIG. 2 is a longitudinal cross-sectional view of the inner working portion of a holder from which the lipstick has been removed.

FIG. 3 is a longitudinal cross-sectional view of the inner sleeve showing details of the slot construction.

DETAILED DESCRIPTION OF THE DRAWING

As shown in FIG. 1, the dispenser comprises, a holder assembly 10 for holding a cosmetic 11, such as lipstick or the like, a top or cover 29 which is preferably constructed of a transparent material, and a base 30 which is constructed of transparent material and contains a cosmetic 31. Preferably, the cosmetic 11 and cosmetic 31 are the same color and more preferably from the same manufacturing batch of cosmetic.

As shown in FIGS. 2 and 3, holder 10 for the lipstick 11 or other soft solid material comprises a cylindrical elevator cup 12 mounted for longitudinal or vertical movement in an inner cylinder or sleeve 13. Projecting from the outer cylindrical surface of the cup are a pair of diametrically opposed lugs or drift-pins 14 and 15 which are adapted to pass through a pair of diametrically opposed slots 16 and 17 formed in the side wall of the inner sleeve. Each slot or track of the inner sleeve consists of a lateral or horizontal portion 18 and two longitudinal or vertical portions 19 and 20 extending respectively upward and downward from the opposing ends of the lateral portion. Near the top end of the upper longitudinal portion 19 is longitudinal slot 20 having a lateral passage 21. The end of the lateral passage and the lateral portion in between is adapted to receive and hold the lugs or drift-pins. To assure retention of the lug when in position, the width of the lateral slots or tracks is narrowed at the points of where longitudinal and lateral slots intersect. These restrictions 23 serve to hold the lug in place but do not offer resistance to the movement of the lug when mechanical force is applied. Sleeve 13 is joined to base 30 and is preferably molded as one part.

In order to move the cup to a desired position there is a cylindrical outer sleeve 24 capable of rotation about the inner sleeve and retained axially by the shoulder 25 on the inner sleeve. In the inner surface of the cylindrical wall of the outer sleeve are two diametrically opposed helicoidal grooves 26 and 27 which are engaged by the ends of the lugs to provide longitudinal motion to the cup. The bottom of the cup is desirably provided with one or more openings or vents 28 to permit expulsion of air when the lipstick is inserted into or molded in the cup.

It will be appreciated by those skilled in the art that the holder mechanism described in FIGS. 2–3 is but a preferred example of a mechanism for dispensing the cosmetic. Other examples of suitable mechanisms are detailed in U.S. Pat. No. 3,515,493 and U.S. Pat. No. 2,644,577.

The entire assembly may be constructed of plastic or other suitable material. If desired, certain portions of the assembly may be reinforced with metal bands, or a decorative outer shell or sleeve may be utilized.

In manipulating the holder, the lipstick may be moved up and down as desired. When in use, the cup is retained in place by the upper lateral passage 21. If it is desired to expose the lipstick when on display, the cup is retained in place by the lateral portion 18 of the slot. When not in use, the lipstick is moved down and the cup remains at the bottom of passage 20. The advantage to the dispenser described is that base 30 is made from a transparent material and is filled with cosmetic. Preferably, the cosmetic filling the base is the same color, or more preferably, from the same manufactured batch, as the molded cosmetic in the holder. Thus the displayer-dispenser clearly and accurately exposes the true color of the molded cosmetic contained within the dispenser and avoids the use of expensive and inaccurately colored plastic "bullets".

It should be appreciated that the present invention is not to be construed as being limited by the illustrative embodiments. It is possible to produce still other embodiments without departing from the inventive concepts herein disclosed. Such embodiments are within the ability of those skilled in the art.

What is claimed is:

1. A cosmetic displayer and dispenser having a holder assembly adapted to hold a first cosmetic, a cover and a base, the improvement comprising, said base being constructed of transparent material and fillable with cosmetic.

2. The cosmetic dispenser of claim 1, wherein said cosmetic is lipstick.

* * * * *